United States Patent [19]

Calvi

[11] 3,985,433

[45] Oct. 12, 1976

[54] CONTROL CIRCUIT FOR ELECTROSTATIC COPYING MACHINE

[75] Inventor: Salvatore J. Calvi, Stamford, Conn.

[73] Assignee: Pitney-Bowes, Inc., Stamford, Conn.

[22] Filed: Apr. 22, 1974

[21] Appl. No.: 462,615

[52] U.S. Cl. ..... 355/3 R; 219/216

[51] Int. Cl.[2] ..... G03G 15/20

[58] Field of Search ..... 219/216, 388, 501; 355/14, 3

[56] References Cited

UNITED STATES PATENTS

| | | | |
|---|---|---|---|
| 3,398,259 | 8/1968 | Tregay et al. | 219/216 |
| 3,512,885 | 5/1970 | Osborne et al. | 355/14 |

*Primary Examiner*—L. T. Hix
*Assistant Examiner*—Kenneth C. Hutchison
*Attorney, Agent, or Firm*—Donald P. Walker; William D. Soltow, Jr.; Albert W. Scribner

[57] ABSTRACT

An electrostatic copying machine of the type which includes apparatus for forming a developed graphic image on, for example, a sheet of paper, and includes a heatable enclosure space within which the image bearing paper is disposable and apparatus for heating the space to bond the image to the paper; is provided with a circuit for controlling operation of the machine in consideration of the temperature of the enclosure space. The circuit includes a switch for energizing the forming and heating apparatus from a suitable source of electrical power, and a switch for actuating the energized forming apparatus. In addition, the circuit includes apparatus for sensing the temperature of the space and disabling operation of the actuating switch, and thus the forming apparatus, until the enclosure space heats up to a predetermined graphic-image-bonding temperature level. Further, the circuit includes apparatus for preventing disablement of the aforesaid actuating switch until the energized forming apparatus has been thereafter deenergized; and includes a lamp for visually signalling whether or not the enclosure space has heated up to the predetermined temperature level.

3 Claims, 1 Drawing Figure

CONTROL CIRCUIT FOR ELECTROSTATIC COPYING MACHINE

BACKGROUND OF THE INVENTION

Commercially available electrostatic copying machines of the type which perform processes wherein an electrostatic latent image formed on a photoconductor is developed by contacting the same with a dry developer material, and wherein the developed image is subsequently transferred from the photoconductor to a suitable supporting substratum such as paper, are generally provided with a dry developer material of the type which has a toner component including a thermally meltable resin mixed with a suitable toning pigment to facilitate thermally bonding the otherwise easily movable and smudgeable transferred image to the paper. Accordingly, such copying machines generally include a suitable heatable enclosure of fuser wherein the transferred-image bearing paper is typically heated to a temperature of from 100° to 300° C for image bonding purposes, before the paper is subsequently processed and/or discharged from the machine.

Inasmuch as such commercial machines are generally utilized by non-technical personnel, instruction manuals accompanying the same usually include indefinite instructions to the effect that the machine operator should "wait awhile" or a "few minutes" before utilizing the machine for copying purposes, to allow the fuser sufficient time to heat up to its bonding temperature level. On the other hand, a given copying machine may well be ready to be used after a delay of exactly 60 seconds after having been initially energized, under circumstances wherein the fuser space is initially at ambient temperature due to the machine not having been recently emergized; or in exactly 20 seconds, under circumstances wherein the fuser space is initially above ambient temperature due to the machine having been relatively recently used. Of course the aforesaid time intervals vary from machine to machine due to variations in toner materials, machine structure, service time intervals and other well-known factors. As a result, operators of copying machines must rely on their own experience with a particular machine in order to avoid wasting paper due to prematurely using the machine or wasting time due to waiting too long to use the machine. Accordingly;

An object of the present invention is to provide an improved electrostatic copying machine;

Another object is to provide an electrostatic copying machine, of the type which includes a heatable fuser space, with a circuit for controlling operation of the machine in consideration of the temperature of the fuser space; and Yet another object is to provide such a control circuit with means for visually signaling the operator when the machine is ready to be used for copying purposes.

SUMMARY OF THE INVENTION

The invention is directed to an improved electrostatic copying machine of the type which includes suitable apparatus for forming a developed graphic image on a supporting substratum, a heatable enclosure space within which the image is bondable to the substratum through the application of heat to the image, and apparatus for heating the enclosure space. To control the operation of the machine in consideration of the temperature of the enclosure space, the machine includes a control circuit including a first switching device for energizing and deenergizing the forming and heating apparatus from a suitable source of supply of electrical power, and a second switching device for independently actuating the energized forming apparatus. In addition, the control circuit includes a temperature actuated device for discontinuing energization of the heating apparatus when the enclosure space heats up to a predetermined temperature level suitable for bonding the graphic image to the supporting substratum. To delay operation of the forming apparatus until the enclosure space is thus heated, the control circuit includes means for preventing operation of the second switching device until the enclosure space is heated. In addition, the control circuit includes means for disabling the last named means after the heating apparatus has been energized, to permit the heating apparatus to maintain the enclosure space at the predetermined temperature level until the forming apparatus has been thereafter deenergized.

DESCRIPTION OF THE PREFERRED EMBODIMENT

Figure 1:
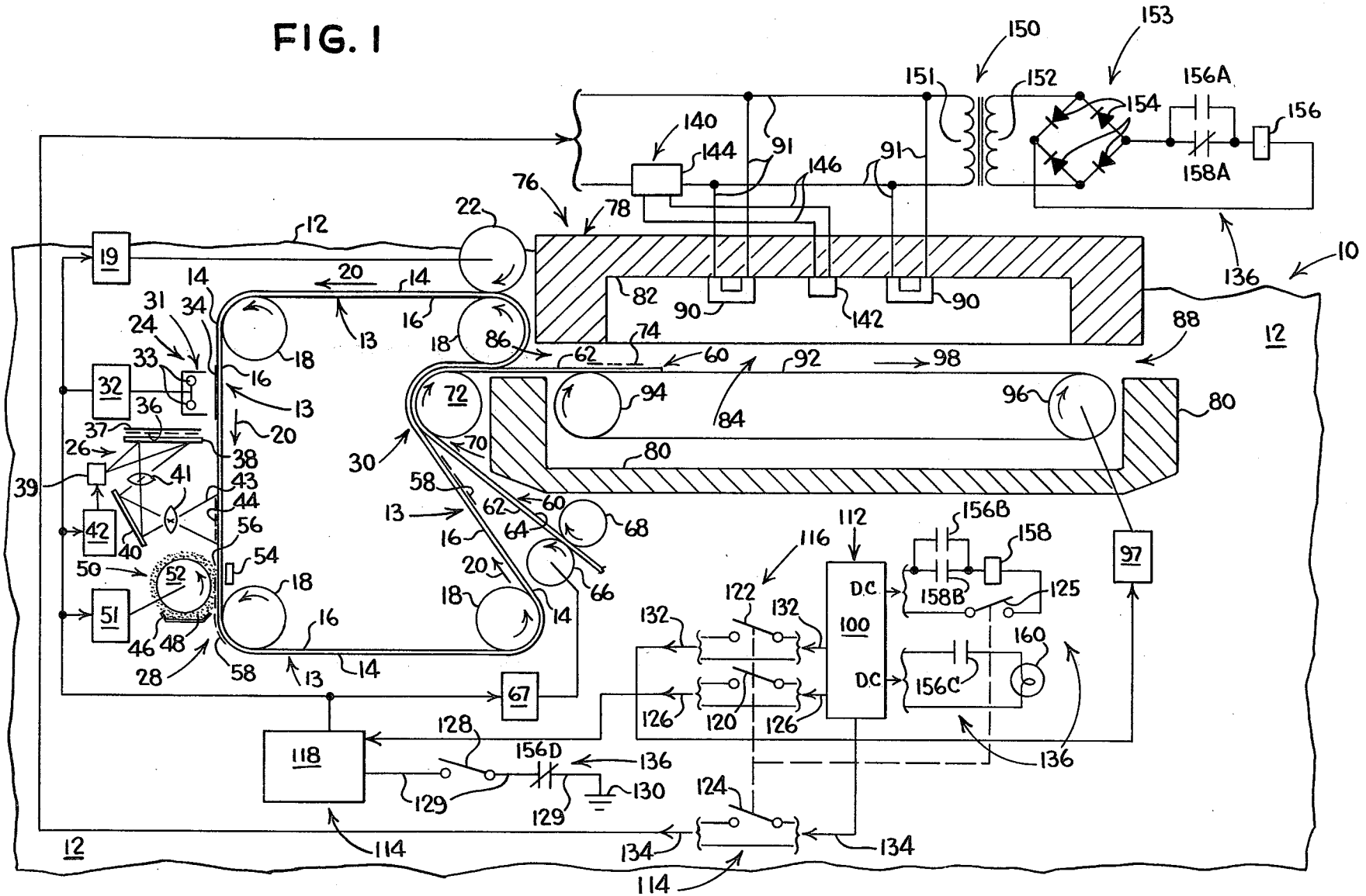
FIG. 1 is a schematic diagram of an electrostatic copying machine of the type which includes apparatus for forming a developed graphic image on a sheet of paper and an enclosed space within which the developed image is bondable to the paper through the application of heat to the image, and according to the invention, a control circuit for controlling operation of the copying machine in consideration of the temperature of the enclosed space.

As shown in FIG. 1, an electrostatic copier or copying machine 10, of the type which may be improved in accordance with the present invention, generally includes suitable framework 12 for supporting the various components of the copier 10, including a photoconductor 13. The photoconductor 13 is made of a suitable strip of material having an outer surface 14 treated to exhibit photoconductive characteristics, and an inner surface 16.

To movably support the photoconductor 13 within the copier 10, the copier 10 includes a plurality of elongated rotatable idler shafts 18 about which the photoconductor 13 is suitably endlessly looped with its inner surface 16 disposed in engagement with the respective shafts 18. The idler shafts 18 are disposed parallel to one another and suitably secured to the framework 12 so as to longitudinally extend transverse to a desired path of travel 20 of the photoconductor 13. In addition, the copier 10 includes an elongated rotatable driven shaft 22 and suitable electrically-energizeable means 19 for driving the shaft 22. The driven shaft 22 is suitably secured to the framework 12 so as to extend parallel to the respective shafts 18 and rotate in engagement with the outer surface 14 of the photoconductor 13, for moving the photoconductor 13 in the aforesaid path of travel 20 past a charging station 24, imaging station 26, developing station 28, and transferring station 30.

At the charging station 24, the copier 10 includes a suitable corona charging device 31 and suitable electrically-energizeable means 32 for driving the device 31. The charging device 31 includes, for example, a pair of elongated high-voltage, charging electrodes 33 suitably spaced from the moving photoconductor 13 and oriented relative to the same so as to longitudinally extend transverse to the photoconductor's path of travel 20, for depositing electrostatic charges 34 of suitable polarity on the photoconductor surface 14.

At the imaging station 26 the copier 10 includes suitable means for providing the photoconductor 13 with information in the form of a graphic image 36 carried by a document 37 which is supported, for example, on a glass platen 38. To that end, the copier 10 includes a suitable light source 39, reflector 40, lens system 41 and electrically-energizeable means 42 cooperative with one another for flash exposing the document 37 and photoconductor 13 with light 43 modulated by the graphic-image 36 on the document 37. The graphic-image modulated light 43 causes the photoconductor 13 to conduct and dissipate sufficient charge 34 from the photoconductor's outer surface 14 to provide the same with a developable electrostatic latent image 44.

At the developing station 28, the copier 10 includes a suitable container 46 for locally holding a reusable supply of developing material 48, a suitable developer material transporting device 50 and suitable electrically-energizeable means 51 for driving the device 50. The transporting device 50 comprises, for example, an elongated rotatable shaft 52 and an elongated magnet 54 magnetically coupled to one another. The magnet 54 and shaft 52 are located on opposite sides of the photoconductor 13 and suitably secured to the framework 12 so as to longitudinally extend parallel to one another, out of contact with the moving photoconductor 13 and transverse to the photoconductor's path of travel 20. The rotating shaft 52 carries developer material 48 from the container 46 into a suitably narror space 56 between the shaft 52 and photoconductor surface 14, wherein the magnetic field (not shown) of the magnet 54 brings carried developer material 48 into contact with the moving photoconductor 13. As a result, some of the toner material of the carried developer material 48 adheres to the latent image 44 so as to render the image 44 visible; thereby forming a transferable, developed image 58 on the outer surface 14 of the moving photoconductor 13.

The developed image 58 is then transferred from the photoconductor surface 14 to a suitable supporting substratum, such as a sheet of paper 60 having an outer surface 62 and an inner surface 64. To feed the paper 60 to the transferring station 30 the copier 10 includes an elongated, rotatable, driven shaft 66; suitable electrically-energizeable means 67 for driving the shaft 66; and an elongated, rotatable, idler shaft 68. The shafts 66 and 68 are oriented so as to longitudinally extend parallel to one another and transverse to the path of travel 20 of the moving photoconductor 13. In addition, the shafts 66 and 68 are respectively suitably secured to the framework 12 for rotation in engagement with the outer and inner surfaces 62 and 64 of the sheet of paper 60, to move the paper 60 in a desired path of travel 70 to the transferring station 30.

At the transferring station 30 the copier 10 includes an elongated, rotatable, idler shaft 72 suitably secured to the framework 12 so as to longitudinally extend parallel to the shafts 66 and 68 and transverse to the respective paths of travel 20 and 70 of the moving photoconductor 13 and sheet of paper 60. The rotating shaft 72 is disposed in engagement with the inner surface 64 of the moving paper 60, and in sufficiently close proximity to the moving photoconductor 13 to forceably urge the outer surface 62 of the paper 64 into sufficiently intimate engagement with the image bearing outer surface 14 of the moving photoconductor 13 to transfer toner from the developed image 58 to the paper 60. As a result, a developed graphic image 74 is formed on the outer surface 62 of the paper 60.

The graphic image 74 is thereafter fused to the paper 60 through the application of heat to the image 74. To that end, the copier 10 includes a suitable image bonding device such as a fuser 76. The fuser 76 is suitably secured to the framework 12 and includes an insulated enclosure 78 having a base 80 and cover 82 arranged to define a heatable space 84. The fuser 76 also includes an inlet 86 and an outlet 88, and, to heat the enclosure space 84, heating means such as a pair of elongated electrically-energizeable, infrared heating elements 90 suitably secured to the cover 82 and electrically connected in parallel to one another via conducting means 91. In addition, the fuser 76 includes a movable belt 92, and elongated, rotatable idler shaft 94, an elongated, rotatable driven shaft 96 and suitable electrically-energizeable means 97 for driving the shaft 96. The shafts 94 and 96 are suitably secured to the fuser 76 so as to longitudinally extend parallel to one another and to a desired path of travel 98 of the sheet of paper 60 within the enclosure 78; and the belt 92 is endlessly looped about the shafts 94 and 96 for moving the paper 60 in the desired path of travel 98.

The copier 10 also includes a suitable internal source of supply of electrical power 100, adapted by well-known means to be energized from an external source of input power 112, and a control circuit 114 for controlling energization of the various electrically-energizeable energizeable means, 19, 32, 42, 51, 67, 91 and 97, from the energized power source 100. The control circuit 114 generally includes switching means such as a master switch 116 for energizing and deenergizing the copier 10, and suitable printing logic circuitry 118 for controlling formation of the developed image 74 on the paper 60.

The master switch 116 is a two position manually-operable switching device including first, second, third and fourth normally open switching contacts 120, 122, 124 and 125.

The first switching contact 120 is electrically connected via conducting means 126 between the internal power supply and the printing logic circuitry 118 in an arrangement such that in the closed and open positions of the master switch 116 the power supply 100 and logic circuitry 118 are respectively electrically connected to and disconnected from one another via switching contact 120 for respectively energizing and deenergizing the printing logic circuitry 118. The print logic circuitry 118 includes a manually operable, normally open, two-position switch including switching contact 128. In the closed position switching contact 128 connects the remainder of the printing logic circuitry 118 via conducting means 129 to a suitable potential level such as ground level 130 for starting operation of the energized print logic circuitry 118, and in the open position the switching contact 128 disconnects the logic circuitry 118 from ground level 130 for stopping operation of the energized printing logic circuitry 118.

The second switching contact 122 is electrically connected via conducting means 132 between the power supply 100 and belt driving means 97 in an arrangement such that in the closed and open positions of the switch master switch 116 the power supply 100 and belt driving means 97 are respectively electrically connected to and disconnected from one another via switching contact 122, for respectively energizing and deenergizing the belt driving means 97. The third switching contact 124 is electrically connected via conducting means 134 in a circuit arrangement such that in the closed and open positions of the master switch 116 the power supply 100 and conducting means 91 are respectively electrically connected to and disconnected from one another via switching contact 124 for respectively energizing and deenergizing the fuser heating elements 90.

To control the copier 10 according to the invention, in consideration of the temperature of the fuser space 84, the control circuit 114 comprises fuser logic circuitry 136 including temperature actuated means 140 suitably electrically connected between the aforesaid switching contact 124 and the parallel connected fuser elements 90. The temperature actuated means 140 includes a suitable temperature sensitive device such as a thermocouple 142 attached to the fuser cover 82, and suitable temperature responsive means 144 electrically connected via conducting means 146 to the thermocouple 142. The temperature responsive means 144 is arranged to normally electrically connect the switching contact 124 and fuser elements 90 to one another via the conducting means 91 and 134 for energizing the fuser elements 90. In addition, in response to the fuser space 84 heating up to a predetermined temperature level suitable for bonding the graphic image 74 to the paper 60, the temperature responsive means 144 is arranged to electrically disconnect the switching contact 124 and fuser elements 90 from one another for deenergizing the fuser elements 90. Accordingly, the temperature actuated means 140 cooperates with switching contact 124 to discontinue energization of the energized fuser elements 90 when the fuser space 84 heats up to the aforesaid predetermined temperature level.

The fuser logic circuitry 136 also includes power converting means including a step-down transformer 150 having a primary winding 151 and secondary winding 152, and a full-wave bridge circuit 153 having a plurality of semiconductor diodes 154. The transformer primary winding 151 is connected across the fuser elements 90 for energization when the fuser elements 90 are energized, and the input to the bridge circuit 153 is connected across the transformer secondary winding 152 to provide a suitable rectified DC output voltage across the output of the bridge circuit 153 when the fuser elements 90 are energized. In addition, the fuser logic circuitry 136 includes a suitable relay having an electrically-energizeable coil 156 arranged to actuate a plurality of two-position switches including normally open relay contacts 156A, 156B and 156C and a normally closed relay contact 156D; a suitable relay having an electrically-energizeable coil 158 arranged to acutate a plurality of two-position switches including a normally closed relay contact 158A and a normally open relay contact 158B; and a lamp 160. Relay coil 156 is electrically connected in series with a parallel combination including relay contacts 156A and 158A; the series circuit thus formed being electrically connected across the output of the bridge circuit 153. Relay coil 158 is electrically connected in series with the fourth master switching contact 125 and a parallel combination including relay contacts 156B and 158B; the series circuit thus formed being electrically connected across a suitable source of supply of DC power provided by the energized power supply 100. Relay contact 156C is connected in series with the lamp 160; the series circuit thus formed being electrically connected across a suitable source of DC power provided by the energized power supply 100. And, relay contact 156D is electrically connected in series with the start-stop printing switch 128.

Assuming the power supply 100 is energized and an operator has placed a graphic-image bearing document 37 on the glass platen 38 and operated the master switch 116, the printing logic circuitry is energized via the master switching contact 120 and conducting means 132; the fuser belt driving means 97 is energized via the master switching contact 122 and conducting means 132; and the fuser heating elements 90 are energized via the master switching contact 124, conducting means 134, temperature responsive means 144 and conducting means 91. As a consequence of the heating elements 90 being energized, the relay coil 156 is energized via the transformer 150, bridge circuit 153 and series connected closed relay contact 158A. Energization of the relay coil 156 closes relay contact 156A, causing the relay coil 156 to be maintained energized from the bridge circuit 153 through contact 156A; closes relay contact 156B, causing the relay coil 158 to be energized from the source 100 through relay contact 156B and the master switching contact 125; closes relay contact 156C, causing the lamp 160 to be energized from the source 100 through relay contact 156C; and opens relay contact 156D, causing the start-stop printing switch 128 to be disabled. When the relay coil 158 is energized, relay contact 158A opens, causing the relay coil 156 to be energized solely through its own closed contact 156A; and relay contact 158B closes for maintaining the relay coil 158B energized through the master switching contact 125 and relay contact 158B as well as relay contact 156B.

Since the printing switch 128 is then disabled, the operator cannot actuate the energized printing logic circuitry 118. Accordingly, the various means 19, 32, 42, 51 and 61 controlled by the printing logic circuitry 118 for forming a developed image 74 on a sheet of paper 60, are prevented from being energized from the source 100 via the printing logic circuitry 118, when the fuser elements 90 are initially energized. In addition, since relay contact 156C is closed at this time, the lamp 160 is energized from the source 100 to provide a visual indication to the operator that the copier 10 cannot be operated for printing purposes.

After a delay of say 60 seconds, the fuser space 84 is heated up to the aforesaid predetermined temperature level suitable for bonding the graphic image 74 to the sheet of paper 60. As a consequence, the thermocouple 142 signals the temperature responsive means 144, via the conducting means 146, that the fuser space 84 is at a temperature which is suitable for image bonding purposes. In response to this signal, the temperature responsive means 144 is automatically actuated to open the circuit between the conducting means 91 and 134 so as to disconnect the fuser elements 90 from the source 100; thereby deenergizing the fuser elements 90. When the fuser elements 90 are deenergized, the transformer 150, bridge circuit 153 and relay coil 156 are also deenergized. Deenergization of the relay coil 156 opens relay contact 156A, thereby disabling subsequent energization of the coil 156 through its own contact 156A. Although deenergization of the relay coil 156 opens relay contact 156B, the relay coil 158 is maintained energized from the source 100 through its own closed contact 158B. On the other hand, deenergization of the relay coil 156 closes relay contact 156D, thereby enabling the operator to actuate the printing switch 128; and opens relay contact 156C, thereby extinguishing the lamp 160 to visually signal the operator that the copier 10 may be operated for printing purposes. The relay coil 156 and contacts 156A and 156D thus delay operation of the printing circuitry 118, and thus energization of the various means 19, 32, 42, 51 and 67 controlled by the printing logic circuitry 118, until such time as the fuser space 84 heats up to a predetermined temperature suitable for bonding the image 74 to the paper 60.

During subsequent time intervals when the copier 10 is being used for printing purposes, the fuser space 84 may well become cool enough to cause the thermocouple 142 to signal the temperature responsive means 144 to close the connection between the conducting means 91 and 134. In such instances the temperature responsive means 144 is automatically actuated in response to the signal to reconnect the fuser elements 90 to the source 100 via the closed switch contact 124. However, although a difference in potential is then impressed across the transformer primary winding 151, the relay coil 156 is not energized since relay contact 158A is held open by the energized relay coil 158 until such time as the master control switch 116 is operated to open switching contact 125. Accordingly, the relay coil 158 and contacts 158A and 158B disable operation of the relay coil 156 and contacts 156A, 156B, 156C and 156D after the heating elements 90 have been energized and until the master switching means 116 has been actuated so as to deenergize the printing control circuit 118 for deenergizing the various means 19, 32, 42, 51 and 67 controlled by the printing logic circuitry 118 for forming the developed graphic image 74 on the paper 60.

Assuming the master control switch 116 is actuated to open the switching contacts 120, 122, 124 and 125, the relay coil 158 will be deenergized, thereby causing switching contact 158A to close to enable the relay coil 156 to be energized through contact 158A when the master control switch 116 is thereafter actuated to close switching contact 120, 122, 124 and 125. In the event that the master control switch 116 is thus actuated and the fuser space 84 has not cooled to ambient temperature, the fuser space 84 will heat up to the aforesaid predetermined temperature level after a delay of less than 60 seconds. Of course, operation of the fuser logic circuitry 136 is in all respects the same under such circumstances, except for the time delay required for the heating elements 90 to heat up the fuser space 84 to the aforesaid predetermined temperature level suitable for image bonding purposes.

In accordance with the objects of the invention there has been described an electrostatic copying machine including a heatable fuser space and a circuit for controlling operation of the machine in consideration of the temperature of the heated fuser space.

Inasmuch as certain changes may be made in the above described invention without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. An electrostatic copying machine comprising means for forming a developed image on a supporting substratum, a fuser including an enclosure defining a space within which the developed image is heatable for bonding to the substratum, means for heating the fuser enclosure space, a source of supply of electrical power, and a control circuit comprising:

a. first switching means for energizing said forming and heating means from the source and deenergizing said forming and heating means;

b. second switching means for operating said energized forming means;

c. temperature actuated means for discontinuing energization of the heating means when the fuser enclosure space initially heats up to a predetermined temperature level and for thereafter automatically energizing and deenergizing said heating means to maintain the temperature of the fuser enclosure space at levels suitable for image bonding purposes;

d. delay means for preventing operation of the second switching means until the fuser enclosure space initially heats up to said predetermined temperature level, said delay means including third switching means responsive to energization of the fuser for disabling operation of said second switching means until the fuser enclosure space initially heats up to said predetermined temperature level, thereby preventing operatioan of the energized forming means until the fuser space initially heats up to said predetermined temperature level; and e. control means for disabling said delay means after said heating means has been initially energized and until said forming means has been thereafter deenergized, said control means including fourth switching means responsive to energization of said third switching means for disabling response of said third switching means to energization of the fuser after the fuser has been initially energized and until the forming means has been thereafter deenergized.

2. The control circuit according to claim 1, wherein said control means includes a lamp adapted to be energized in response to energization of said third switching means and deenergized in response to deenergization of said forming means.

3. The control circuit according to claim 1, wherein said third switching means comprises a first relay operable in response to initial energization of the fuser enclosure space, and said fourth switching means includes a second relay operable in response to energization of said first relay, and said first and second relays each having a contact electrically connected to maintain energization thereof.

* * * * *

UNITED STATES PATENT OFFICE

CERTIFICATE OF CORRECTION

Patent No. 3985433 Dated October 12, 1976

Inventor(s) Salvatore J. Calvi

It is certified that error appears in the above-identified patent and that said Letters Patent are hereby corrected as shown below:

Column 1, line 36, change "emergized" to -- energized --.

Column 3, line 34, change "narror" to -- narrow --.

Column 4, line 34, take out the second occurrence of "energizeable".

Claim 1, under d., column 8, line 38, change "operatioan" to -- operation --.

Signed and Sealed this

Seventh Day of June 1977

[SEAL]

*Attest:*

RUTH C. MASON
*Attesting Officer*

C. MARSHALL DANN
*Commissioner of Patents and Trademarks*